US005892167A

United States Patent [19]

Kenmochi

[11] Patent Number: 5,892,167

[45] Date of Patent: Apr. 6, 1999

[54] KEY MECHANISM OF BASSOON

[75] Inventor: Hiroshi Kenmochi, Hamamatsu, Japan

[73] Assignee: Yamaha Corporation, Japan

[21] Appl. No.: 977,830

[22] Filed: Nov. 25, 1997

[30] Foreign Application Priority Data

Nov. 28, 1996 [JP] Japan ..... 8-317768

[51] Int. Cl.[6] ..... G10D 7/00

[52] U.S. Cl. ..... 84/380 R; 84/385 P; 84/386; 84/388

[58] Field of Search ..... 84/385 P, 380 R, 84/386, 388

[56] References Cited

U.S. PATENT DOCUMENTS

| | | | |
|---|---|---|---|
| 4,723,470 | 2/1988 | Yamaryo | 84/380 |
| 4,798,122 | 1/1989 | Gisler et al. | 84/385 |
| 4,957,029 | 9/1990 | Kahonen | 84/384 |
| 5,237,922 | 8/1993 | Hamanaga | 84/386 |

*Primary Examiner*—William M. Shoop, Jr.
*Assistant Examiner*—Kim Lockett
*Attorney, Agent, or Firm*—Ostrolenk, Faber, Gerb & Soffen, LLP

[57] ABSTRACT

A bassoon equipped with a key mechanism is constructed by a tube which consists of a tenor joint, a double joint, a long joint and a bell joint. Herein, three sound holes corresponding to sounds of E, B♭ and F♯ are located in the double joint. Three keys corresponding to E, B♭, F♯ are provided to open or close the three sound holes respectively and are all manipulated by the fingering using only a thumb of a right hand of a performer. Herein, an E key which is the center of the three keys is specialized in construction. That is, the E key which is located to cover the E sound hole is constructed by a pad cup and a key body whose size is reduced as compared with the conventional one. Two recesses are formed at both sides of the key body respectively. In addition, two rollers are held by the two recesses above the pad cup. The rollers are located to partially overlap with the pad cup in a plan view, however, elevation of the rollers is different from that of the pad cup. An axial distance between the rollers is made smaller than an outer diameter of the pad cup. Thanks to reduction of the size of the E key as a whole, it is possible for the performer to move the thumb of the right hand from the E key to the B♭ key or to the F♯ key with ease. Thus, it is possible to respond to fast passage with ease.

3 Claims, 3 Drawing Sheets

KEY MECHANISM OF BASSOON

BACKGROUND OF THE INVENTION

1. Field of the Invention

This invention generally relates to a key mechanism of a bassoon, and particularly to a structure of an E key to open or close a sound hole of E of a bassoon. This application is based on patent application No. Hei 8-317768 filed in Japan, the content of which is incorporated herein by reference.

2. Prior Art

A bassoon (i.e., Fagott in German or fagotto in Italian) is a kind of woodwind instruments. The bassoon provides a key mechanism which operates to open or close sound holes which are arranged along a tube. A conventional example of the basson will be explained in conjunction with FIG. 3 and FIGS. 4A, 4B. FIG. 3 is a side view in left side of the bassoon; FIG. 4A is a plan view showing a part of the key mechanism whilst FIG. 4B is a front view of the key mechanism partially in section and partially broken away. As shown in the above figures, a tube 5 of the bassoon is constructed by a tenor joint 1, a double joint 2, a long joint 3 and a bell joint 4. A key mechanism 6 is provided around an outer periphery of the tube 5 to open or close sound holes each of which corresponds to each of prescribed notes (e.g., B♭, B, C, C♯, . . . ). With respect to the key mechanism 6, an E key 7, a B♭ key 8 and a F♯ key 9 are provided to open or close sounds holes 6*a*, 6*b* and 6*c* respectively, which correspond to the prescribed notes of E, B♭ and F♯. The keys 7, 8 and 9 are arranged in parallel in a width direction of the tube and in proximity to each other. Those three keys are selectively operated by the fingering using only a thumb of a right hand of a performer. The E key 7 is located at the center of the three keys. A structure of the E key 7 is shown in FIGS. 4A and 4B. Herein, the E key 7 provides a key body 11, which acts as a key lever and a pad cup 12 as well, and a pad P. The E key 7 is arranged to cover the E sound hole 6*a*. Rollers 13 and 14 are provided at both sides of the key body 11 in a free rotation manner. A hook 15 is formed as an integral part of the key body 11 and is a projection which projects from a part of the key body 11. A key rod 16 is provided in a free rotation manner at an outer periphery of the double joint 2. So, the hook 15 is supported by the key rod 16. Key levers 17 and 18 are provided for the B♭ key 8 and the F♯ key 9 respectively and are arranged at both sides of the key body 11. Rollers 19 and 20 are provided for the key levers 17 and 18 respectively in a free rotation manner and are arranged to face with the rollers 13 and 14 of the key body 11 respectively. The rollers 13, 14, 19 and 20 are used to provide easy fingering for the thumb of the right hand of the performer with respect to the key body 11 and the key levers 17, 18. Incidentally, recesses 21 and 22 are formed at both sides of the key body 11 to hold the rollers 13 and 14 respectively.

The conventional example of the bassoon described above has a problem in terms of the fingering of the thumb of the right hand, as follows:

As shown in FIG. 4A, the rollers 13 and 14 of the E key 7 are arranged outside of the outer periphery of the pad cup 12. For this reason, a relatively long distance 'L' should be provided between the rollers 13 and 14. Due to the long distance L between the rollers 13 and 14, a long distance should be inevitably provided between the E key 7 and the B♭ key 8 and between the E key 7 and the F♯ key 9. When performing on the bassoon, the thumb of the right hand requires a certain range of movement from the E key 7 to the key lever 17 of the B♭ key 8 or to the key lever 18 of the F♯ key 9. However, due to the long distance described above, the thumb of the right hand should move in a relatively broad range of movement. So, it is difficult for the performer to subjecting the thumb of the right hand to fast passage (e.g., rapid ascending of notes or rapid descending of notes) within the sounds (or notes) of E, B♭ and F♯.

SUMMARY OF THE INVENTION

It is an object of the invention to provide a key mechanism of a bassoon which is capable of improving the fingering with respect to the thumb of the right hand of the performer and which is capable of well responding to fast passage with respect to the thumb of the right hand.

In the bassoon equipped with a key mechanism of this invention, three sound holes corresponding to sounds of E, B♭ and F♯ are located in the double joint of the tube. Three keys corresponding to E, B♭, F♯ are provided to open or close the three sound holes respectively and are all manipulated by the fingering using only a thumb of a right hand of a performer.

This invention aims at reduction in size of an E key, which is the center of the three keys, as a whole.

The E key is located to cover the E sound hole and is constructed by a pad cup and a key body whose size is reduced as compared with the conventional one. Two recesses are formed at both sides of the key body respectively. In addition, two rollers are held by the two recesses above the pad cup. The rollers are located to partially overlap with the pad cup in a plan view, however, elevation of the rollers is different from that of the pad cup. An axial distance between the rollers is made smaller than an outer diameter of the pad cup.

The reduction of the size of the E key as a whole results in reduction in distance of movement by which the thumb of the right hand moves from the E key to the B♭ key or to the F♯ key. Therefore, this invention provides an improvement in performability of the keys or performability of the bassoon, so it is possible to respond to fast passage with ease.

BRIEF DESCRIPTION OF THE DRAWINGS

These and other objects of the subject invention will become more fully apparent as the following description is read in light of the attached drawings wherein.

DESCRIPTION OF THE PREFERRED EMBODIMENT

Now, a description will be given with respect to a key mechanism of a bassoon in accordance with an embodiment of the invention and in conjunction with FIGS. 1 and 2.

Figure 1:
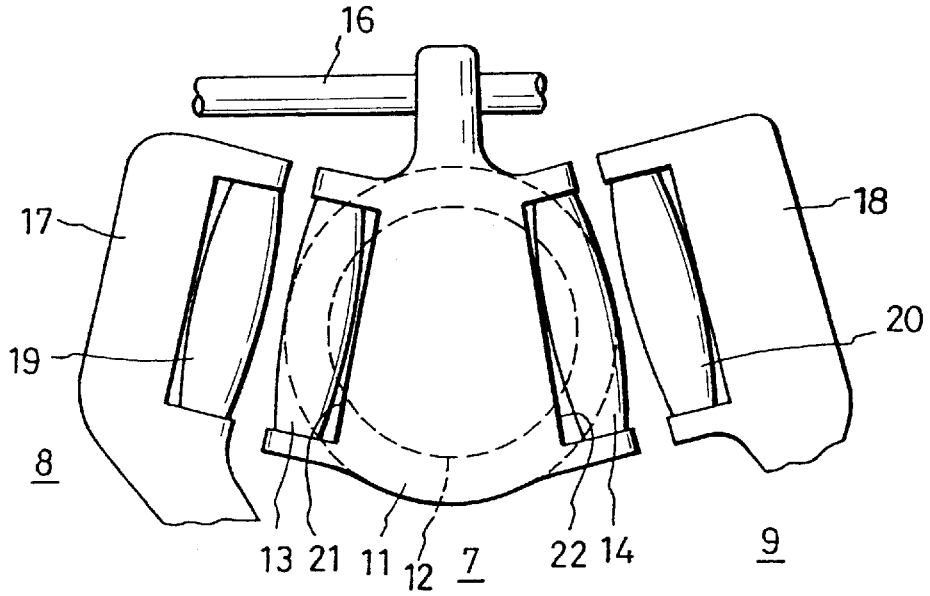
FIG. 1 is a plan view showing a key mechanism of a bassoon in accordance with an embodiment of the invention.
Figure 2:
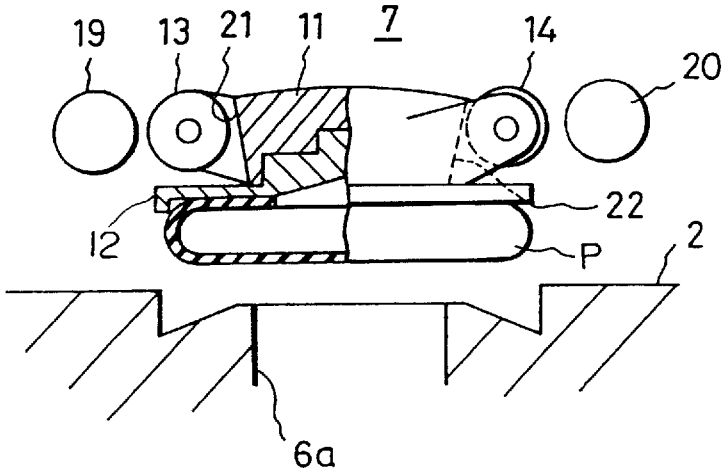
FIG. 2 is a front view of the key mechanism of the bassoon partially in section and partially broken away.
Figure 3:
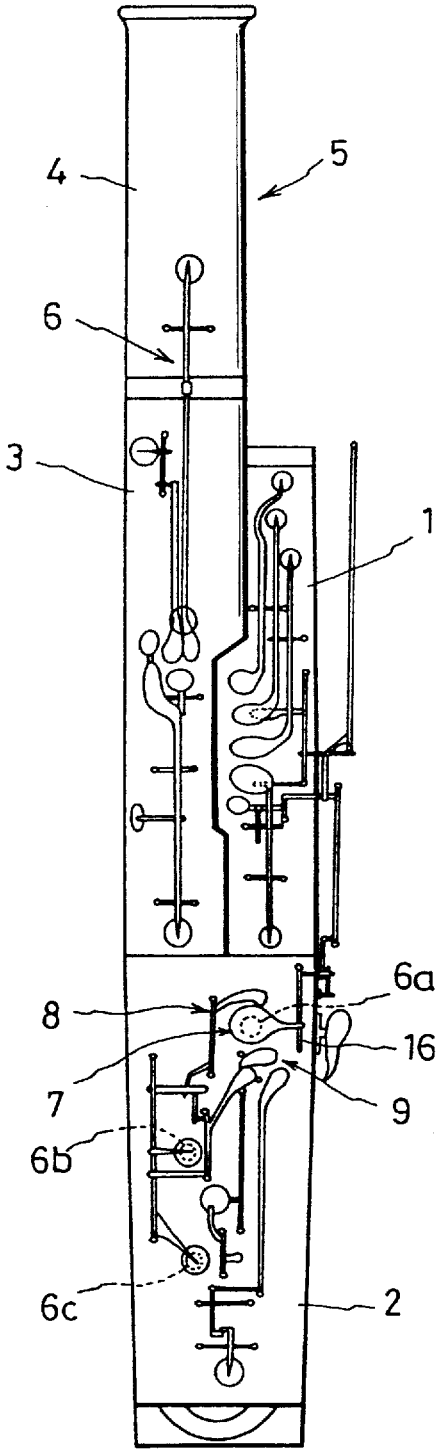
FIG. 3 is a side view in left side of the bassoon conventionally known.

FIG. 1 is a plan view of the key mechanism of the bassoon; and FIG. 2 is a front view of the key mechanism of the bassoon partially in section and partially broken away. In those figures, parts equivalent to those of FIGS. 2, 3, 4A and 4B are designated by the same numerals; hence, the description thereof will be omitted occasionally. The present embodiment is characterized as shown in FIG. 1 that an axial distance between the two rollers 13, 14 provided for the key body 11 of the E key 7 is made smaller than an outer diameter of the pad cup 12. To accomplish this, the key body 11 has a reduced width which is smaller than the width of the conventional key body. In addition, the recesses 21 and 22 are located inside of the outer periphery of the pad cup 12. Then, the rollers 13 and 14 are located above the pad cup 12 and are placed to engage with the recesses 21 and 22 respectively. In other words, at least parts of the rollers 13, 14 overlap with the pad cup 12 in a plan view, however, elevation of the rollers 13, 14 is different from that of the pad cup 12.

In the present embodiment, the rollers 13 and 14 as a whole overlap with the pad cup 12 in such a way that center portions of outer peripheral surfaces thereof are placed in contact with the outer periphery of the pad cup 12. By changing the distance between the rollers 13 and 14, it is possible to freely change a degree of overlapping of the rollers and pad cup. Incidentally, the distance between the rollers 13 and 14 are determined in consideration of the width of the thumb of the right hand. In other words, the distance between the rollers 13 and 14 is set within a range of distances with which the finger cushion of the thumb of the right hand is capable of being in contact with a surface of the key body 11.

As described heretofore, the present embodiment is characterized by that the rollers 13 and 14 are located to (partially) overlap with the pad cup 12 in a plan view. So, it is possible to provide reduction in distance between the rollers 13 and 14. Responding to the reduction of the distance between the rollers 13 and 14, the keys 7 to 9 are arranged such that the B♭ key 8 and the F♯ key 9 can approach the E key 7. As a result, it is possible to reduce a distance of movement by which the thumb of the right hand moves from the E key 7 to the key lever 17 of the B♭ key 8 or to the key lever 18 of the F♯ key 9. Thus, it is possible to respond to fast passage with ease.

Figure 4A:
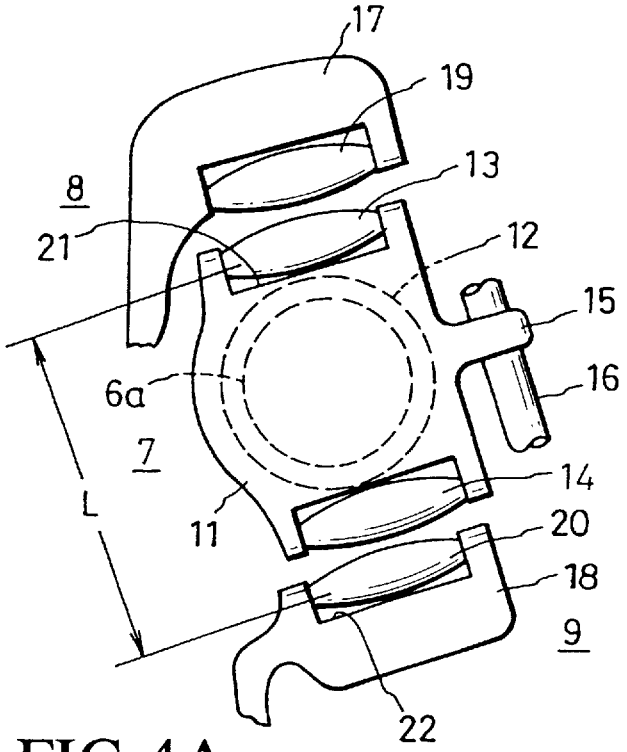
FIG. 4A is a plan view showing a part of a key mechanism of the bassoon of FIG. 3.
Figure 4B:
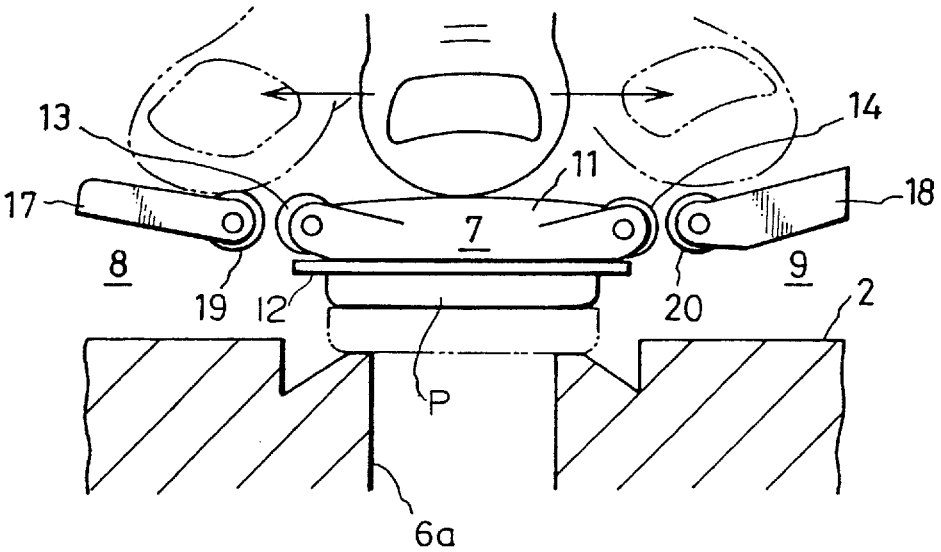
FIG. 4B is a front view of the key mechanism partially in section and partially broken away.

Lastly, the most important feature of this invention can be observed by the comparison between FIG. 4B and FIG. 2 with respect to the construction of the E key 7. According to the conventional construction (see FIG. 4B), the key body 11 contains a function of the pad cup 12; in other words, the pad cup 12 is constructed as an integral part of the key body 11. In contrast, this invention is constructed in such a way that the pad cup 12 is constructed independently of the key body 11 (see FIG. 2).

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. A key mechanism of a bassoon comprising:

a pad cup;

a key body which is located above the pad cup and which operates to open or close a sound hole of E by being manipulated by a thumb of a right hand of a performer who plays the bassoon; and two rollers which are provided at both sides of the key body respectively in a free rotation manner, the two rollers being located above the pad cup in such a way that at least a part thereof overlaps with the pad cup in a plan view.

2. A key mechanism of a bassoon comprising:

a pad cup;

a key body which is located above the pad cup and which operates to open or close a sound hole of E by being manipulated by a thumb of a right hand of a performer who plays the bassoon; and two rollers which are provided at both sides of the key body respectively in a free rotation manner, wherein locations of the key body to hold the two rollers are placed inside of the pad cup in a plan view so that the two rollers partially overlap with the pad cup in a plan view.

3. A key mechanism of a bassoon comprising:

a pad cup which is located to cover the sound hole of E;

a key body which is placed above the pad cup and which operates to open or close the sound hole of E by being manipulated by a thumb of a right hand of a performer who plays the bassoon;

two recesses which are formed at both sides of the key body respectively, wherein an axial distance between the two rollers is smaller than an outer diameter of the pad cup; and two rollers which are held by the two recesses of the key body respectively above the pad cup, wherein the two rollers partially overlap with the pad cup in a plan view.

* * * * *